United States Patent [19]

Lang

[11] Patent Number: 4,719,086

[45] Date of Patent: Jan. 12, 1988

[54] BURET APPARATUS INCLUDING A STOPPER CONTAINING A SIPHON PASSAGE

[75] Inventor: Karl Lang, Jona, Switzerland

[73] Assignee: Mettler Instrumente AG, Greifensee, Switzerland

[21] Appl. No.: 598,038

[22] Filed: Apr. 9, 1984

[30] Foreign Application Priority Data

Jul. 19, 1983 [CH] Switzerland ..... 3938/83

[51] Int. Cl.[4] ..... B01L 3/02; B01L 11/00

[52] U.S. Cl. ..... 422/100; 215/355; 215/356; 422/75; 422/99; 422/103

[58] Field of Search ..... 73/864.01, 864.02; 137/561 R; 215/355-357; 422/75, 99, 100, 103

[56] References Cited

U.S. PATENT DOCUMENTS

| | | | |
|---|---|---|---|
| 2,376,231 | 5/1945 | Cohn | 422/100 |
| 2,396,470 | 3/1946 | Mortensen | 73/864.01 |
| 2,836,979 | 6/1958 | Ryley | 73/864.01 |
| 3,476,518 | 11/1969 | Jungner | 422/100 |
| 4,096,972 | 6/1978 | Bartels et al. . | |
| 4,146,068 | 3/1979 | Jordan | 141/39 |
| 4,241,018 | 12/1980 | Lang | 422/75 |
| 4,391,716 | 7/1983 | McCurry | 210/799 |
| 4,469,151 | 9/1984 | Wilson et al. | 422/100 |

FOREIGN PATENT DOCUMENTS

| | | | |
|---|---|---|---|
| 358654 | 10/1931 | United Kingdom | 422/100 |

*Primary Examiner*—Michael S. Marcus
*Attorney, Agent, or Firm*—Laubscher & Laubscher

[57] ABSTRACT

Buret apparatus of the type including a buret conduit terminating at one end in a siphon, characterized in that the siphon includes a siphon passage formed on a stopper that is removably mounted in the buret conduit. The improved siphon structure is relatively inexpensive to manufacture, and is less susceptible to breakage than the conventional circular glass siphon devices. The improved apparatus is particularly suitable for use as a precision titrator or dosing device where measurements in the microliter range are required.

3 Claims, 3 Drawing Figures

BURET APPARATUS INCLUDING A STOPPER CONTAINING A SIPHON PASSAGE

STATEMENT OF THE INVENTION

This invention relates to an improved buret apparatus including a siphon passage at least partially formed on a stopper removably mounted in the buret conduit.

BRIEF DESCRIPTION OF THE PRIOR ART

Titrating devices are well known in which a quantity of a titrating agent of known concentration is added to a liquid being tested until a certain phenomenon occurs—for example, the measurable change in potential across a pair of electrodes submerged in the sample. The desired content of a certain component in the sample can then be determined as a function of the quantity of titrating agent required to produce the measurable change in the sample.

It is obvious that the accuracy of the measurement depends essentially on the accuracy by which the consumption of the titration agent may be determined. Thus, it is customary to cause the tip of the buret to be immersed in the sample to prevent any drop error from developing.

However, the use of an immersed buret tip presents a further problem—namely, that of the efflux of an uncontrolled quantity of the titrating agent leaving the buret when the specific gravity of the titrating agent is greater than that of the sample being tested (which frequently occurs, for example, during water determinations according to the procedures of Karl Fischer). In precision measurements, this results in noticeable errors which increase the longer the buret tip remains in the sample (and which are added to the error resulting from the diffusion which occurs through the boundary surface between the titration agent and the sample). One solution to this problem was proposed in the known Metrohm Titroprocessor 636 apparatus, wherein the titrator conduit was isolated from the sample by a membrane operable as a one-way valve, whereby the titration agent was permitted to exit from the apparatus, but the sample was prevented from coming into the same. In this way, both the diffusion error and the density error which results when the titration agent has a specific density greater than that of the sample are substantially completely eliminated. One drawback to this known system is that titrations with maximum resolution cannot be performed in the microliter range since such small increments of the titration agent cannot overcome the closing pressure of the membrane.

To avoid this disadvantage, it was proposed in the Titrator DL 40 apparatus produced by Mettler Instrumente AG, assignee of the present invention, to provide the buret tip with a siphon in the form of a circular glass loop. Owing to the known siphon principle, this apparatus has the effect of permitting a precisely defined limited quantity of a specimen having a lower specific density than that of the titrating agent to enter the upper circle arc of the siphon loop. This quantity can be limited to a few microliters, depending on the dimensions of the buret tip. Owing to the regular flushing of the buret tip normally performed after the end of each titration in a precision measurement, the small quantity of sample fluid does not enter into the measurement error, since the same volume of foreign liquid is present at the beginning and at the end of a measurement, thereby neutralizing the effect on a measurement. Very small volumes can be dosed by the apparatus, although at the price of the diffusion error which must be accepted.

The circular glass siphon has the inherent drawbacks of relatively large manufacturing cost, susceptibility to contamination owing to the problem of careful cleaning, and finally, the great danger of breakage.

The present invention was developed to avoid the above and other drawbacks of the known devices.

SUMMARY OF THE INVENTION

The primary object of the present invention is to provide an improved titration apparatus in which a siphon passage is formed at least in part on a stopper member that is removably mounted in the titrator conduit. While the stopper may be formed from glass for insertion within a glass titrator conduit, preferably the titrator conduit is in the form of a flexible cut-off hose, and the stopper—which is adapted for insertion within the hose—is formed from a synthetic plastic material, whereby the danger of breakage is substantially eliminated. The siphon passage may be formed in any given manner in or on the stopper. In the preferred form of the invention, the siphon passage is formed on the peripheral surface of the stopper, which is preferable from a production engineering standpoint. In one embodiment in which the stopper and conduit are vertically arranged, the siphon passage is in the form of an S-shaped passage arranged on the peripheral surface of the stopper. In another embodiment, the siphon passage comprises a helical passage extending around the periphery of the stopper, which stopper extends horizontally within an orthogonally arranged portion of the titration apparatus.

BRIEF DESCRIPTION OF THE DRAWINGS

Other objects and advantages of the invention will become apparent from a study of the following specification when viewed in the light of the accompanying drawing, in which.

DETAILED DESCRIPTION

Figure 1:
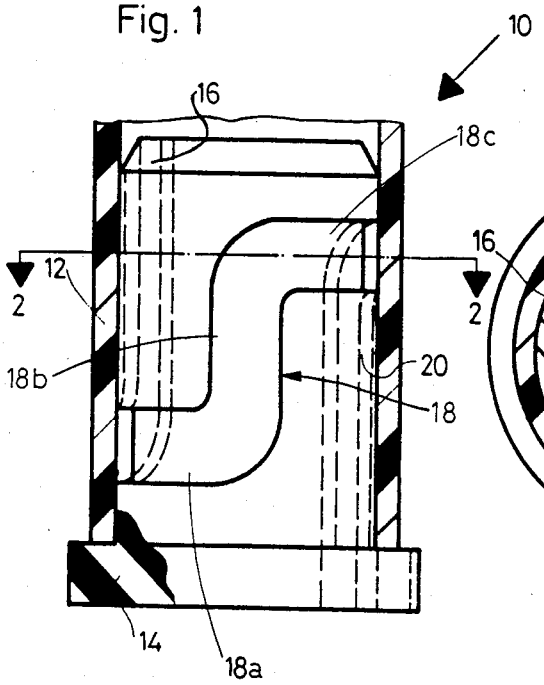
FIG. 1 is a detailed partly sectioned view of a first embodiment of the buret apparatus of the present invention.
Figure 2:
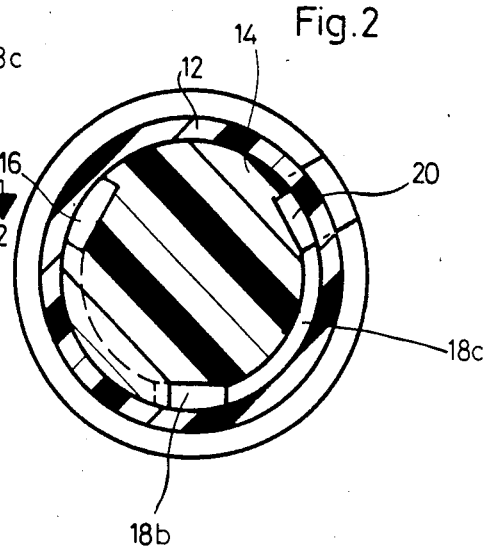
FIG. 2 is a sectional view taken along line 2—2 of FIG. 1.

Referring first more particularly to FIGS. 1 and 2, the buret apparatus 10 of the present invention includes a vertically arranged buret conduit 12, such as the severed end of a hose formed from a synthetic plastic material (for example, polyethylene or tetrafluoroethylene), and containing a through bore with an internal diameter of about 3 mm. Inserted upwardly within the lower end of the conduit is a generally cylindrical stopper 14 preferably formed from the same or a similar material as that of the buret conduit. Alternatively, the buret conduit and the stopper could be formed of glass. According to a characterizing feature of the invention, the stopper contains on its outer periphery an S-shaped siphon passage including a vertical first portion 16 that extends downwardly from the upper end of the stopper, a vertical second portion 20 that extends upwardly from the lower end of the stopper, and a connecting intermediate portion 18 that connects the lower end of portion 16 with the upper end of portion 20. More particularly, the intermediate passage has lower and upper horizontal parts 18*a* and 18*c* connected with the passages 16 and 20, respectively, and a vertical part 18*b* which connects the lower and upper horizontal parts. The cross-sectional area of the siphon passage—which is selected to produce the desired titration speed—is on the order of 0.5–1 $mm^2$.

OPERATION

During operation of the buret as a titrator, the titrating agent is provided in the conduit 12 and the lower extremity of the buret is dipped into the sample to be measured. If the titrating agent has a specific density less than or equal to that of the sample solution, the boundary surface will coincide with the outlet opening at the lower extremity of the second vertical passage portion 20. On the other hand, if the titration agent has a specific density greater than that of the sample, owing to the density difference the sample liquid will enter the siphon passage and, owing to the siphon effect, the boundary surface between the sample liquid and the titration agent will form in the middle or connecting portion 18.

Since, as discussed above, the same foreign volume is contained in the buret tip both before and after titration, in practice only the diffusion error enters into the measurement accuracy. Moreover, another advantage of the insertable stopper is that, upon the occurrence of contamination, it is no longer necessary to replace the circular siphon portion as was the case with the prior glass devices, but rather the stopper need merely be removed for cleaning and reuse. Consequently, even replacement with a new siphon stopper is cheaper than replacing a buret tip of the circular glass type.

Figure 3:
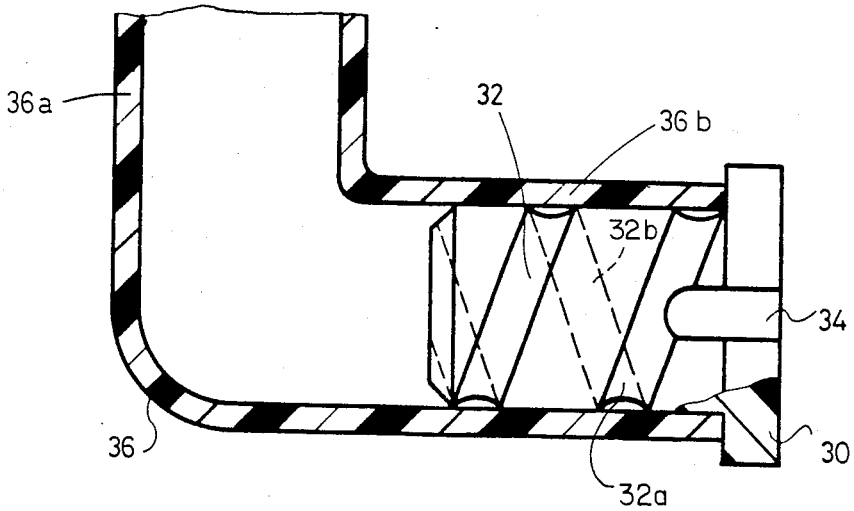
FIG. 3 is a detailed sectional view of a second embodiment of the invention.

Referring now to the modification of FIG. 3, the lower end of the titration conduit 36 is bent, generally with the application of heat, to a horizontal position orthogonally arranged relative to the vertical conduit portion 36*a*. In this case, the stopper 30 is provided on its periphery with a helical siphon passage 32 that extends from the left hand end of the stopper in FIG. 3 and terminates at its other end in communication with horizontal outlet passage 34. Stopper 30 is so inserted that the outlet passage 34 is at a level corresponding with a horizontal plane containing the longitudinal axis of the stopper. Thus, the intermediate siphon passageway portion 32*a* is at a lower elevation than the outlet passage 34 at one end, and the adjacent passageway portion 32*b* at the other end, which adjacent passageway portion extends upwardly to a higher elevation than the outlet passage 34.

The materials and dimensions of the buret of FIG. 3 correspond with those of the embodiment of FIGS. 1 and 2.

While the invention is particularly suitable for use as a titrating device, it can also be used as a device for dispensing precise dosages (of generally small volume) of one fluid into another fluid within which the buret tip is immersed.

Only the inventive features of the buret have been illustrated and described, since the remaining portion of the buret is conventional (as illustrated, for example, in the U.S. Pat. Nos. 4,096,972 and 4,241,018).

What is claimed is:

1. A buret titration apparatus, comprising:

(a) a conduit (12) containing a through bore defining a conduit inner surface, said conduit having at one end a vertically arranged free end portion; and (b) a generally cylindrical stopper member a major portion of which is removably mounted in said conduit end portion, said stopper member being arranged with its longitidinal axis extending vertically, said stopper member having upper and lower ends and an external surface containing a groove which extends generally the length of said stopper member between said upper and lower ends, said stopper member external surface cooperating with the inner surface of said conduit end portion to define a single siphon passageway means for transferring liquid relative to said conduit bore, said siphon passageway means being generally S-shaped and including a vertical intermediate portion (18*b*) having upper and lower ends, said intermediate portion upper and lower ends being spaced from the upper and lower ends of the stopper member, respectively, a vertical first portion (16) extending downwardly from the upper end of, and terminating in spaced relation to the lower end of, said stopper member, a vertical second portion (2) extending upwardly from the bottom end of, and terminating in spaced relation to the upper end of, said stopper member, and means connecting the lower and upper ends of said intermediate portion with the lower and upper ends of said first and second vertical portions, respectively.

2. A buret titration apparatus, comprising:

(a) a conduit (12) containing a through bore defining a conduit inner surface, said conduit having at one end a free end portion adapted for generally vertical orientation during use;

(b) a generally cylindrical vertically arranged stopper member (14) a major portion of which is removably mounted colinearly within said vertically oriented conduit end portion, said stopper member having upper and lower ends, and a cylindrical external surface in engagement with the conduit inner surface; and (c) siphon means associated with said stopper member for transferring liquid relative to said conduit bore, said siphon means comprising a groove contained in the external surface of said stopper member for cooperation with the inner surface of said conduit end portion to define a single generally S-shaped siphon passage (18) extending generally between the upper and lower ends of said stopper member, said siphon passage including a first portion (16) extending downwardly from the upper end of the stopper, a second portion (20) extending upwardly from the lower end of the stopper to an elevation hihger than the lower end of said siphon passage first portion, and an intermediate portion (18) connecting the lower end of said first passage portion with the upper end of said second passage portion.

3. A buret titration apparatus, comprising:

(a) a conduit (36) containing a through bore defining a conduit internal surface, said conduit having at one end a free end portion (36*b*) adapted for generally horizontal orientation during use;

(b) a generally cylindrical horizontally oriented stopper member (30) a major portion of which is removably mounted colinearly within said horizontally oriented conduit free end portion, said stopper member having an external surface in engagement with said conduit inner surface, and inner and outer ends relative to said conduit end portion; and (c) siphon means associatded with said stopper member for transferring liquid relative to the conduit bore, said siphon means comprising a single groove contained in the external surface of said stopper member for cooperation with the inner surface of said conduit end portion to define a generally helical siphon passage (32) extending generally between said stopper member inner and outer ends, said siphon passage terminating adjacent the free end of said horizontal conduit portion in a horizontal outlet duct portion (34) parallel with a longitudinal axis of said stopper member and contained in a horizontal plane which contains the longitudinal axis of said stopper member.

* * * * *